US009114964B2

(12) United States Patent
Spinazze et al.

(10) Patent No.: US 9,114,964 B2
(45) Date of Patent: Aug. 25, 2015

(54) DUAL-SPEED HAND PUMP AIRCRAFT JACK

(71) Applicant: Tronair Inc., Holland, OH (US)

(72) Inventors: Paul A. Spinazze, Toledo, OH (US); John D. Wilson, Ottowa Hills, OH (US)

(73) Assignee: Tronair, Inc., Holland, OH (US)

( * ) Notice: Subject to any disclaimer, the term of this patent is extended or adjusted under 35 U.S.C. 154(b) by 251 days.

(21) Appl. No.: 13/866,295

(22) Filed: Apr. 19, 2013

(65) Prior Publication Data

US 2013/0299760 A1 Nov. 14, 2013

Related U.S. Application Data

(60) Provisional application No. 61/645,695, filed on May 11, 2012.

(51) Int. Cl.

| | |
|---|---|
| ***B66F 3/42*** | (2006.01) |
| ***B66F 5/04*** | (2006.01) |
| ***B66F 3/24*** | (2006.01) |
| ***B66F 3/28*** | (2006.01) |

(52) U.S. Cl.
CPC ... *B66F 3/42* (2013.01); *B66F 3/24* (2013.01); *B66F 3/28* (2013.01); *B66F 5/04* (2013.01)

(58) Field of Classification Search
CPC ..... B66F 3/42; B66F 3/24; B66F 5/04
USPC ..... 254/93 R, 93 H, 89 H, 8 R, 2 B
See application file for complete search history.

(56) References Cited

U.S. PATENT DOCUMENTS

| | | | | |
|---|---|---|---|---|
| 2,214,440 | A * | 9/1940 | Rothery | 254/93 H |
| 2,284,958 | A * | 6/1942 | Grime | 254/1 |
| 2,314,589 | A * | 3/1943 | Mandl | 254/93 H |
| 2,327,180 | A * | 8/1943 | Diercksmeier et al. | 254/1 |
| 2,341,542 | A * | 2/1944 | Grime | 254/93 H |
| 2,416,848 | A * | 3/1947 | Rothery | 248/170 |
| 2,487,792 | A * | 11/1949 | Custer | 254/93 R |
| 3,030,889 | A | 4/1962 | Parker | |
| 3,121,556 | A * | 2/1964 | Faulkner | 254/2 R |
| 5,232,203 | A | 8/1993 | Butts | |
| 5,975,496 | A * | 11/1999 | Hong et al. | 254/2 R |
| 5,992,149 | A * | 11/1999 | Hu | 60/479 |
| 6,105,940 | A * | 8/2000 | Charette | 254/423 |
| 6,368,022 | B1 | 4/2002 | Zingerman | |
| 7,143,998 | B1 | 12/2006 | Hall | |
| 7,275,713 | B2 | 10/2007 | Hillsamer | |
| 7,849,762 | B2 | 12/2010 | Viola | |
| 2009/0134375 | A1 * | 5/2009 | Shi | 254/93 H |

FOREIGN PATENT DOCUMENTS

| | | | | |
|---|---|---|---|---|
| GB | 2021683 | A * | 12/1979 | F04B 49/00 |

* cited by examiner

*Primary Examiner* — Lee D Wilson
*Assistant Examiner* — Tyrone V Hall, Jr.
(74) *Attorney, Agent, or Firm* — Emch, Schaffer, Schaub & Porcello Co. LPA

(57) ABSTRACT

This two-stage jack apparatus for lifting aircraft comprises: a tripod base having three legs; a base tube; a ring having an orifice therethrough, wherein the ring engaging end of each leg is attached to the ring; a cylinder housing a jack wherein the base tube supports the cylinder and wherein the cylinder extends through the orifice of the ring; a two stage hydraulic extension attached to the jack; and a dual speed hand pump comprising a high volume low pressure pump for quick ram actuation to the jack point and a low volume high pressure pump used to actuate rams with a hydraulic pump.

9 Claims, 6 Drawing Sheets

DUAL-SPEED HAND PUMP AIRCRAFT JACK

CROSS REFERENCE TO RELATED APPLICATION

The present patent application is based upon and claims the benefit of provisional patent application No. 61/645,695, filed on May 11, 2012.

FIELD OF THE INVENTION

The present invention relates to an aircraft jack for lifting aircraft. In a preferred embodiment, the jack is a collapsible, two stage, twenty ton tripod jack.

BACKGROUND OF THE INVENTION

This invention relates generally to aircraft jacks and, more particularly, to a jack for raising an airplane above ground level during manufacture and for many other maintenance and repair operations. The jacking of an airplane is extremely critical due to airplane flexibility, high gross weights, and numerous other precautionary measures required.

A common device used to lift aircraft is a tripod jack. Tripod jacks generally include a single aircraft interface point extending above a three legged base. Use of traditional tripod jacks for lifting aircraft has drawbacks. One drawback is the amount of time and energy required to lift the aircraft. Another is variant jacking conditions. A need exists for a single jack solution to address all variant conditions.

SUMMARY OF THE INVENTION

This invention is a tripod jack of a "single solution" jack designed for lifting and supporting variant aircraft. The criteria for a single solution jack (set of 3 jacks per aircraft) will meet all jacking conditions for each variant aircraft and several other aircraft. Single jack design is used on any of the three variant aircraft and several other aircraft at any of the five jacking locations: front (one location), inboard wing (two locations) or outboard wing (two locations). The jacks are designed for the typical landing gear retraction check or landing gear removal and installation. In addition, they are designed to operate on an aircraft carrier while in a sea state 6 condition. They also may support an aircraft in the sea state 8 condition. The jacks themselves are collapsible and can be containerized in restricted space for long term storage or deployment.

The two-stage jack apparatus comprises a tripod base having three legs; with a welded floor pad at the end of each leg, a hydraulic cylinder with telescoping rams with an integrated threaded mechanical extension, a weldment ring which the cylinder is threaded in the center and three mounting holes equally spaced on the outside diameter to attach the tripod base legs; lower support linkage for the legs; base support plate to connecting support linkages and to mount an air driven hydraulic pump and manual dual speed high/low hydraulic hand pump; transparent hydraulic reservoir mounted to the hydraulic cylinder.

Other objects and advantages of the present invention will become apparent to those skilled in the art upon a review of the following detailed description of the preferred embodiments and the accompanying drawings.

IN THE DRAWINGS

DETAILED DESCRIPTION OF THE INVENTION

Figure 1:
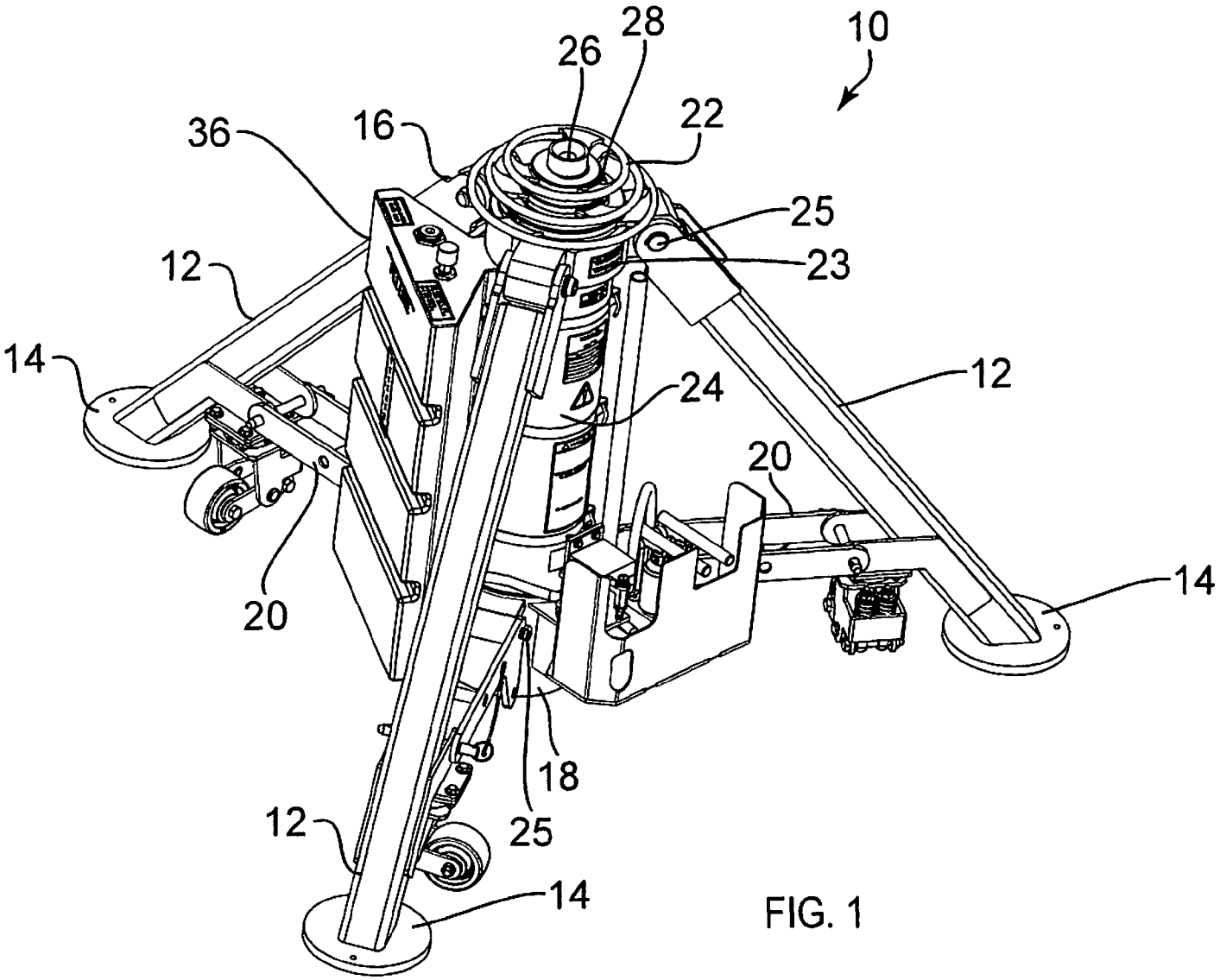
FIG. 1 is an isometric operational view of the jack of this invention.

FIGS. 1 to 5 show: two-stage jack apparatus 10 for lifting aircraft having a fuselage and wing comprising: tripod base having three legs 12 wherein each leg has floor pad 14 engaging opposite end to the ring weldment 23 with pin 25; base tube weldment 18, lower leg support linkages 20 wherein each leg linkage 20 is connected to leg 12 and connected to base tube weldment 18 with pins. Cylinder 24 houses jack rams 28 wherein is threaded into base tube weldment 23 wherein the base tube weldment 18 is bolted. Jack pad 26 is attached to a top end of the jack. A mechanical extension attached to the jack as is a two stage hydraulic extension. A dual speed hand pump comprising a high volume low pressure pump for quick ram actuation to the jack point and a low volume high pressure pump used to actuate rams with a hydraulic pump also are shown. The hydraulic pumps and rams are for raising and lowering the jack.

FIGS. 1 to 5 include the following parts.

| PART NO. | DESCRIPTION |
|---|---|
| 26 | Jack Pad |
| 24 | Cylinder Tube |
| 22 | Stop Collar |
| 20 | Leg Brace |
| 18 | Cylinder Base |
| 16 | Ring Weldment |
| 14 | Leg Weldment Base |
| 12 | Leg Weldment |
| 10 | Aircraft Jack |

GENERAL DESCRIPTION:

1. WEIGHT: 885 LBS
2. OPERATIONAL DIMENSIONS
   WIDTH: 64.0"
   LENGTH: 56.5"
   CLOSED HEIGHT: 40.0"
3. MECHANICAL EXTENSION: 15"
4. HYDRAULIC EXTENSION: 51"
5. EXTENDED HEIGHT: 106"
6. COLLAPSED DIMENSIONS:
   WIDTH: 28.5"
   LENGTH: 30.5"
   CLOSED HEIGHT: 50.0"
7. FINISH: GRAY PAINT

Figure 2:
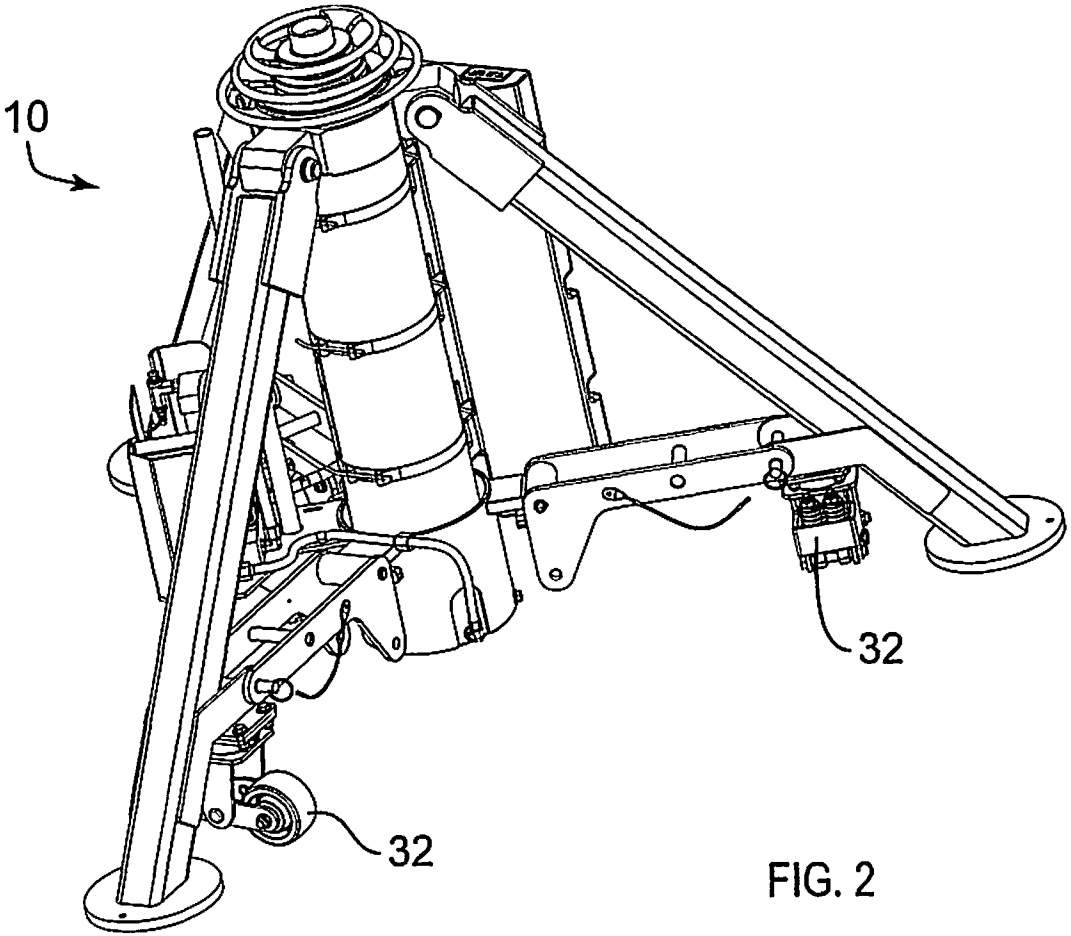
FIG. 2 is another isometric operational view of the jack of this invention.

FIG. 2 is another isometric operational view of the jack of this invention. FIG. 2 shows the backside of apparatus 10 shown in FIG. 1.

Figure 3:
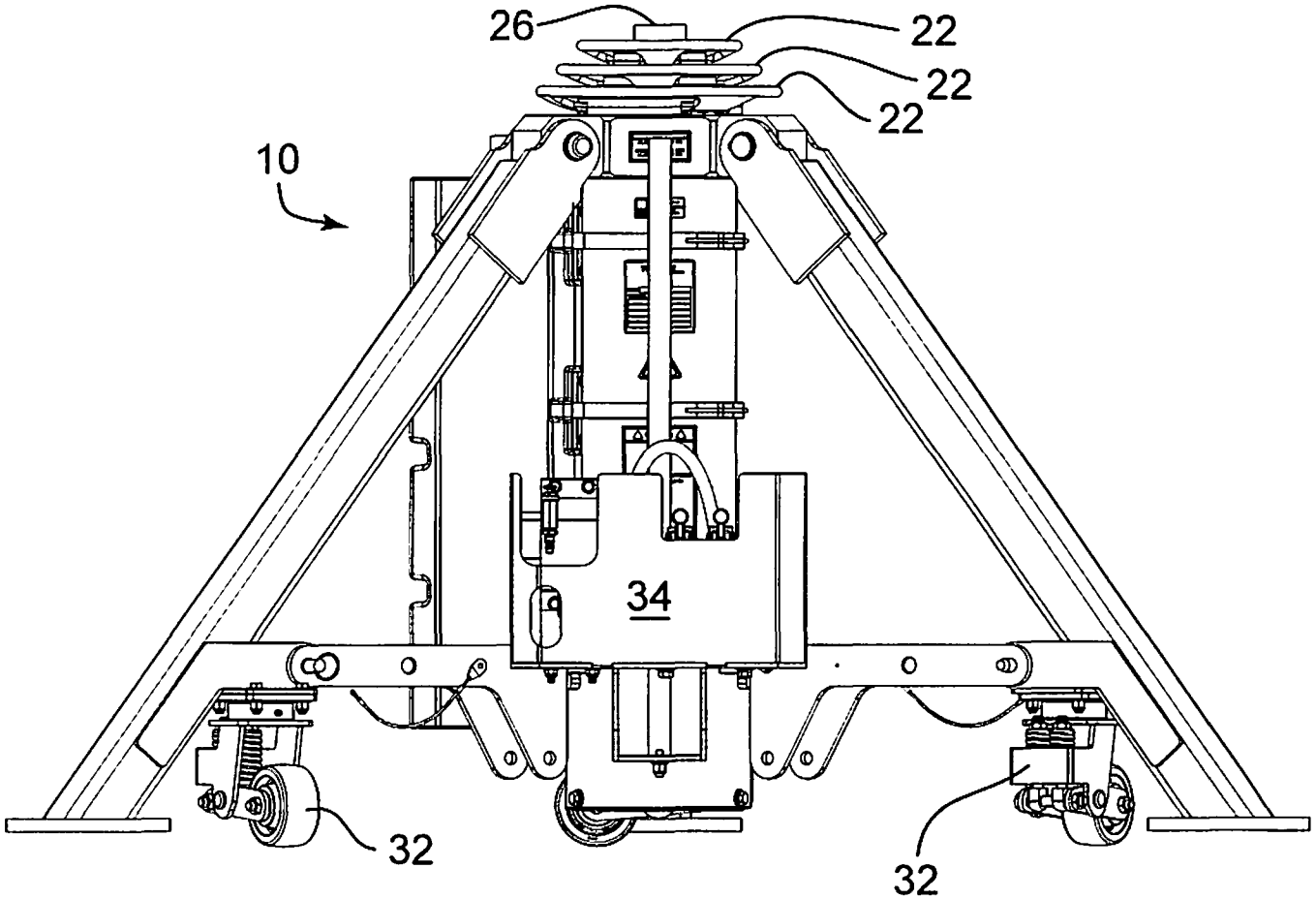
FIG. 3 is a side view operational of the jack of this invention.

FIG. 3 is a side view operational of the jack of this invention. FIG. 3 shows spring loaded casters 32 in greater detail. FIG. 3 also shows air and hand pump guard 34 in greater detail.

Figure 4:
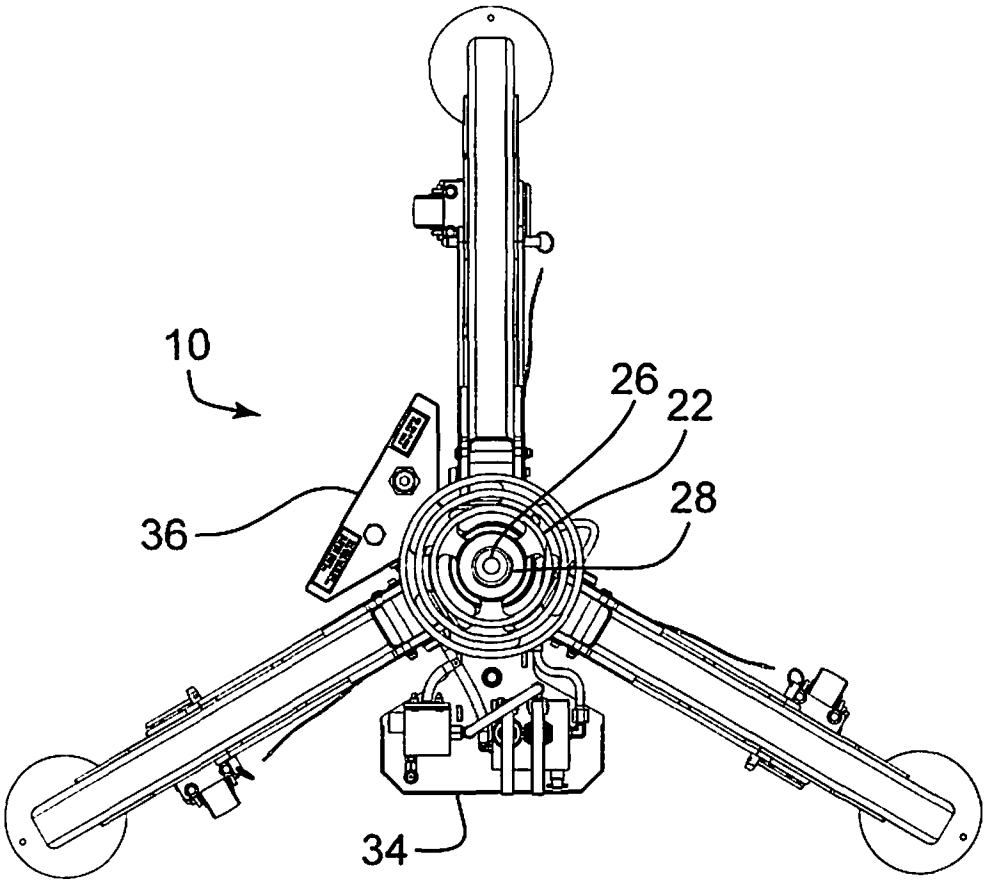
FIG. 4 is a top view operational of the jack of this invention.

FIG. 4 is a top view operational of the jack of this invention. FIG. 4 shows stop collar 22, jack pad 26 and jack ram 28. FIG. 4 also shows reservoir 36.

Figure 5:
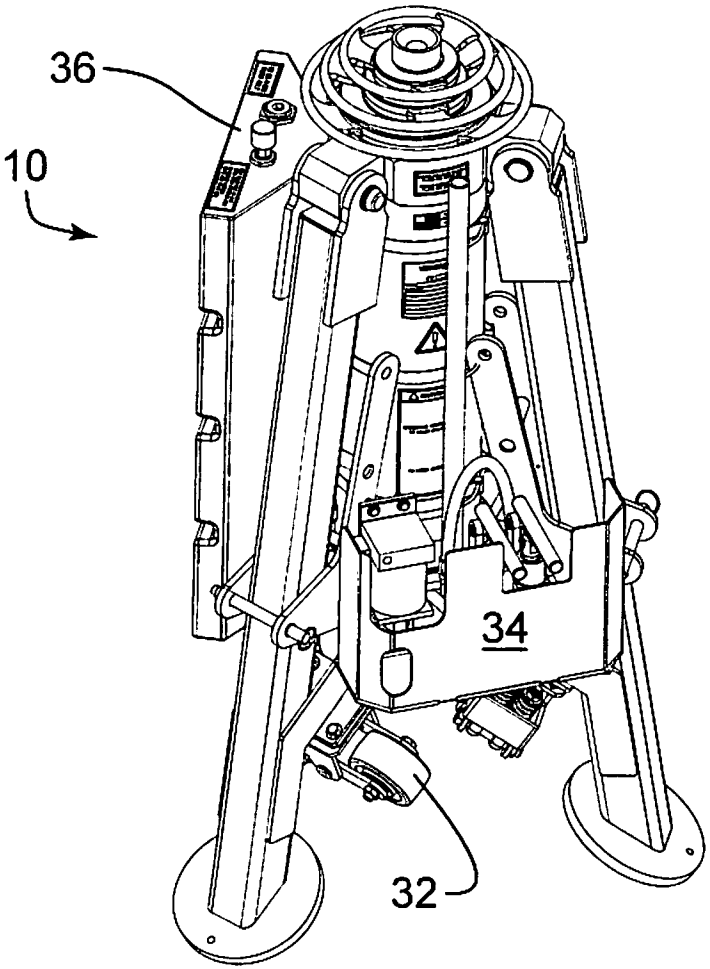
FIG. 5 is an isometric view collapsed of the jack of this invention.

FIG. 5 is an isometric view collapsed of the jack of this invention.

Figure 6:
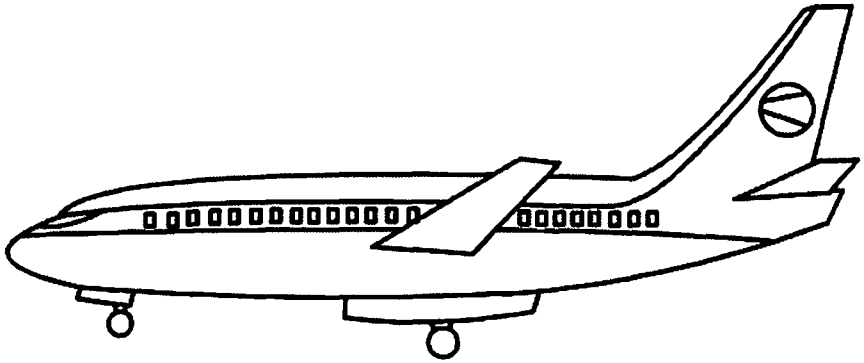
FIG. 6 is a general view showing a typical aircraft.

FIG. 6 is a general view showing a typical aircraft.

Example

The following is a preferred embodiment of the invention.

Major Operating Components:

Dual speed hydraulic hand pump: Highly resistant to corrosion. Built with stainless steel 303 series parts and plated per MIL-C-26074, class 1, grade C specification. Two pumps are featured: high volume low pressure pump for quick ram actuation to the jack point and a low volume high pressure pump used to actuate rams without the air driven hydraulic pump. The hand pump handle will not exceed 50 lbs of force to operate by hand. The pump features a pressure release ball to allow fluid to return quickly back to reservoir from the cylinder.

Air driven hydraulic pump: Marine grade, ⅓hp pump that operates on common ship air supply of 90 psi.

Polyethylene Reservoir: Tank material is cross linked polyethylene material. Has a high resistance to puncture, stress cracking, thermal resistance and notch failure. The material is transparent which provides simple reservoir fluid level detection. The vent is leak proof for storage or deployment.

Spring loaded casters: Highly resistant to corrosion. Caster wheels are built with a glass reinforced nylon that will resist wear on aircraft decking.

Hardware components: All hardware components are built with corrosion resistant stainless steel material or plated per MIL-C-26074, class 1, grade C.

Specifications:

- Plating: per MIL-C-26074, class 1, grade C
- Paint: Gray
- Overall Width: 64"
- Overall Length: 56.5"
- Closed Height: 40"
- Hydraulic Extension 51"
- Extended Height: 106"
- Collapsed Dimensions
  - Width: 28.5"
  - Length: 30.5"
  - Height: 50.0"
- Weight: 885 pounds
- Operating temperature range: −4° to 122° F.

Loading Specifications

- Sea State 6: Rams and mechanical extension fully extended supporting full rated capacity with a horizontal load at 15% capacity. Safety factor of rams 1.75 and structural 2.0
- Sea State 8: Rams and mechanical extension at lowest configuration while maintain a level aircraft. Locking collar is engaged to utilize the structural safety for the jack tripod frame and not the hydraulics. Horizontal load at 23% of capacity and vertical load is 89%. Safety factor of structural is 2.
- Internal hydraulic pressure equal to 1½ time pressure at rated capacity without leakage.

Operating Instructions:

To Raise Aircraft:

1. Place jack on a hard, level surface.
2. Open reservoir vent screw (counterclockwise)
3. Hydraulic rams must be completely retracted before operating the jack.
4. Raise mechanical extension as close to aircraft jack pad as possible.
5. Close pump release valve and operate either hand pump or air pump.
6. Hydraulic rams must extend in order from largest to smallest diameter.
7. Large diameter hydraulic ram must fully extend before the next stage ram begins to raise.
8. Lower mechanical ram locknut(s) while extending rams. Keep within 1 inch of bottom of extending ram.
9. Do not continue to operate air pump after all rams have fully extended.

To Lower Aircraft:

1. Lower all jacks simultaneously.
2. If ram locking collar(s) is tight, raise jack slightly to release collar(s) ¼ from tripod.
3. Ensure proper staging as aircraft is being lowered: loosen ram locking collar nut
   beginning with smallest ram (1 inch max) until stage is completely lowered. Repeat for next largest stage.
4. Loosen pump release valve slightly and slowly lower aircraft.

To Collapse Jack:

1. Utilize a flexible 1 inch wide strap, secure entire jack with strap under weldment ring and lift vertically.
2. Remove quick disconnect pin in leg linkage and fold leg in and re-secure with pin. Repeat for each leg.
3. Lower collapse jack to the ground and lay jack on open side (without reservoir and pumps).
4. Remove flexible strap.

The above detailed description of the present invention is given for explanatory purposes. It will be apparent to those skilled in the art that numerous changes and modifications can be made without departing from the scope of the invention. Accordingly, the whole of the foregoing description is to be construed in an illustrative and not a limitative sense, the scope of the invention being defined solely by the appended claims.

We claim:

1. A two-stage jack apparatus for lifting aircraft having a fuselage, the apparatus comprising:

- a tripod base having three legs wherein each leg has a base, surface, engaging end and a higher ring engaging end;
- a base tube;
- three leg braces, wherein each leg brace is connected to the base end of the leg and connected to the base tube;
- a stop collar having an orifice therethrough, wherein the ring engaging end of each leg is attached to the ring;
- a cylinder housing a jack wherein the base tube supports the cylinder and wherein the cylinder extends through the orifice of the ring;
- a jack pad attached to a top end of the jack;
- a mechanical extension attached to the jack;
- a two stage hydraulic extension attached to the jack;
- a dual speed hand pump comprising a high volume low pressure pump for quick ram actuation to the jack point and a low volume high pressure pump used to actuate rams with a hydraulic pump; and
- hydraulic pumps and rams for raising and lowering the jack.

2. An apparatus according to claim 1 further comprising a welded floor pad attached to the base end of the leg.

3. An apparatus according to claim 1 wherein the cylinder is a hydraulic cylinder with telescoping rams with an integrated threaded mechanical extension.

4. An apparatus according to claim 1 further comprising a weldment ring wherein the cylinder is threaded in the center and has three mounting holes equally spaced on the outside diameter to attach the tripod base legs.

5. An apparatus according to claim 1 further comprising a lower support linkage for the legs; a base support plate to connecting support linkages and to mount an air driven hydraulic pump and manual dual speed.

6. An apparatus according to claim 5 further comprising a high/low hand pump; transparent hydraulic reservoir mounted to the hydraulic cylinder.

7. An apparatus according to claim 1 further comprising lower leg support linkages connected to each leg wherein each lower leg support linkage is connected to the base tube.

8. An apparatus according to claim 7 further comprising spring loaded casters wherein each spring loaded caster is attached each lower leg support.

9. An apparatus according to claim 1 further comprising a control panel connected to the apparatus.

* * * * *